US005484061A

United States Patent [19]

Dunn

[11] Patent Number: 5,484,061

[45] Date of Patent: Jan. 16, 1996

[54] ELECTROSTATIC SIEVING APPARATUS

[75] Inventor: John P. Dunn, Penn Yan, N.Y.

[73] Assignee: Advanced Electrostatic Technologies, Inc., Hammondsport, N.Y.

[21] Appl. No.: 215,489

[22] Filed: Mar. 21, 1994

Related U.S. Application Data

[63] Continuation-in-part of Ser. No. 924,897, Aug. 4, 1992, abandoned.

[51] Int. Cl.[6] ..... B03C 7/00

[52] U.S. Cl. ..... 209/127.4; 209/129; 209/380

[58] Field of Search ..... 209/127.1, 127.3, 209/127.4, 129, 128, 130, 379, 380; 15/1.5

[56] References Cited

U.S. PATENT DOCUMENTS

| | | | |
|---|---|---|---|
| 2,361,946 | 8/1940 | Johnson et al. | 209/127.3 |
| 2,707,556 | 5/1955 | Gear et al. | 209/127.3 |
| 2,803,344 | 11/1954 | Morrison | 209/127.4 |
| 2,848,108 | 8/1958 | Brastad et al. | 209/129 X |
| 3,247,960 | 4/1966 | Brastad | 209/11 |
| 3,249,225 | 5/1966 | Stuetzer et al. | 209/129 |
| 3,346,110 | 10/1967 | LaFranca, Jr. et al. | 209/127.1 X |
| 3,635,340 | 1/1972 | Dunn | 209/130 |
| 4,071,169 | 1/1978 | Dunn | 222/71 |
| 4,172,028 | 10/1979 | Dunn | 209/127.1 X |
| 4,229,285 | 10/1980 | Wild | 209/380 X |

FOREIGN PATENT DOCUMENTS

| | | | |
|---|---|---|---|
| 1217495 | 3/1986 | U.S.S.R. | 209/127.4 |

*Primary Examiner*—William E. Terrell
*Assistant Examiner*—Tuan Nguyen
*Attorney, Agent, or Firm*—Barnard, Brown & Michaels

[57] ABSTRACT

An apparatus for classifying particles by size comprising: a source of direct potential having first and second terminals, a sieve electrode connected to the first terminal, a solid electrode connected to the second terminal. Particles are fed to a transfer point located between the sieve electrode and the solid electrode such that the particles disperse and oscillate between the sieve electrode and the solid electrode whereby smaller particles pass through the sieve electrode. The new equipment has five adjustable operating parameters, screen angle, spacing between electrodes, field strength, powder input rate and electrode taper. The taper between electrodes is usually small, 0.3 to 0.4 of a degree with the larger opening at the top. The taper is used when the input powder is fine and the particle size differential is skewed either towards the high or low side. The purpose of the taper is to reduce the possibility of arcing at the input as well as to control dispersion of the particles. The solid electrode may be flat, or contoured in side-to-side sine wave, step or sawtooth patterns, or in dimples across the surface, to increase the oscillation of particles. A plurality of parallel wire electrodes may be added perpendicular to the long axis of the sieve and solid electrodes at the same potential as the solid electrode in order to increase turbulence and particle oscillation.

23 Claims, 14 Drawing Sheets

Fig. 12 Apparatus Setup and Operating Sequence for Single Stage Electrostatic Sieve
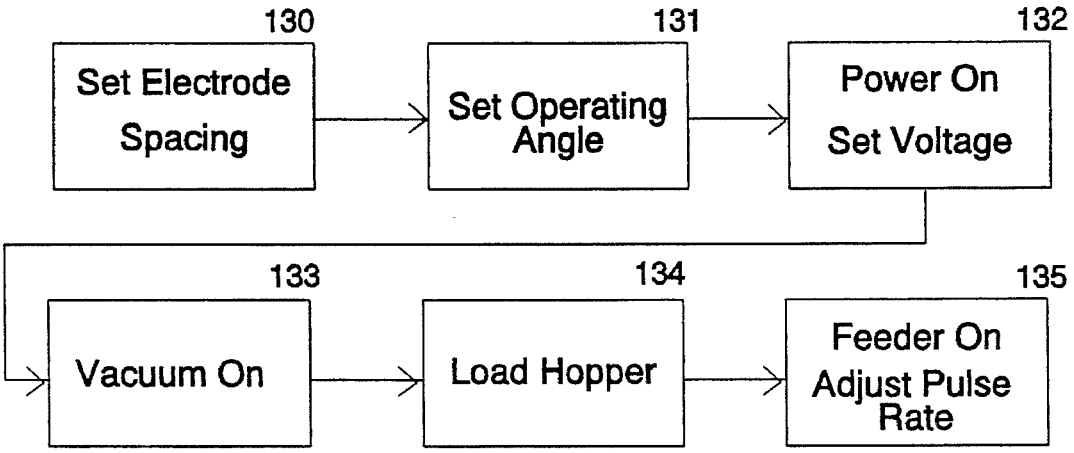
Fig. 13 Process Sequence for Single Stage Electrostatic Sieve
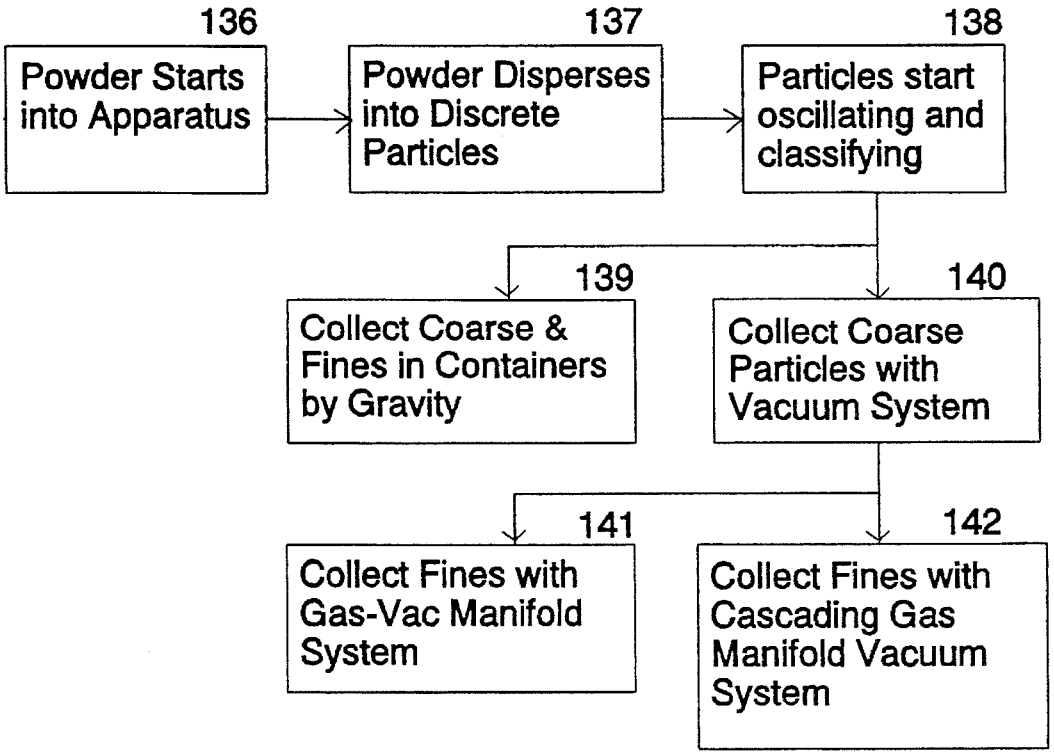

ELECTROSTATIC SIEVING APPARATUS

REFERENCE TO RELATED APPLICATION

This is a continuation-in-part of application Ser. No. 07/924,897, filed Aug. 4, 1992, now abandoned.

FIELD OF THE INVENTION

The present invention relates to apparatus and methods for separating particles which are capable of being moved by an electrostatic field, and more particularly relates to apparatus and methods for separating or classifying particles by oscillating the particles between electrodes, at least one of which is a screen or sieve electrode.

BACKGROUND OF THE INVENTION

Present equipment that use precision sieves are batch type units where the powder is processed on reinforced screen and collected directly on the screen. This requires that for each batch that is processed the mounted screens have to be handled at the beginning and end of the process, resulting in the possible damage to the screen. Examples of this type of equipment include the Alpine Air-Jet Sieve and the ATM Sonic Sifter.

The concept of passing particles through an electrostatic field for the purpose of propelling the particles beyond a screen is disclosed in my U.S. Pat. No. 3,635,340. This patent discloses the use of particle momentum produced by pulling the particles across a field to propel particles through a printing screen. Further, it is also disclosed that this propulsion of the particles beyond a second electrode may be used for possible particle classification. This patent, however, does not recognize or utilize particle oscillation as the vehicle for screen trials. It was further disclosed that particle separation could be accomplished by passing the particles across a horizontal conveying electrode which relied upon vibration to move the particles to the screen or stencil electrode mounted above the horizontal vibrating electrode.

Another example of the use of electrostatic separation of particles known in the prior art is shown in U.S. Pat No. 2,361,946 to Johnson et al. The Johnson et al patent discloses an electrostatic separation of particles which utilizes direct fields or alternating fields for the production of particle dispersion, agitation and propulsion between electrodes. The Johnson et al patent utilizes an inclined electrode configuration where the sieve electrode is placed below an upper electrode. Where it is desired to use direct potentials, the upper electrode is a bare, solid, metallic electrode. A solid upper electrode has been found to be required in apparatus which use an inclined electrode configuration. The use of such electrodes, however, allows fine particles to adhere to the surface in local areas and thus produces variations in the electrical field strength, and sparking and possible stoppage of the process.

In the Johnson et al patent, the principal phenomena relied upon is the attraction and repulsion of particles between electrodes of an opposite charge. A particle by reason of the charge received from the lower sieving electrode is propelled upwardly to the upper electrode plate from which, by contact therewith, it receives the opposite charge and is propelled back down to the lower electrode. Particles which do not actually touch the upper electrode may also be propelled downward by gravity.

In the Johnson et al patent, there is no recognition of the potential use of the inherent oscillation of a dispersed group of particles between electrodes of a like charge.

The prior art has also utilized electrostatic fields for the separation of particles through the technique of passing the particle through a field and relying upon the mass-to-charge ratio to accomplish the separation. An example of this is found in U.S. Pat. No. 2,803,344 to Morrison, which utilizes gravity to separate the particles as they pass across an electrostatic field. This technique, however, does not rely upon the oscillating motion produced by the electrostatic dispersion to propel the particles to a classifying screen. In this apparatus, there is no requirement that the particles oscillate during separation since there is no classification screen against which trails are made.

Another patent which uses electrostatic separation, but which does not utilize the oscillation of particles in free fall against a sieve under the influence of an electrostatic field, is Brastad, el. al, U.S. Pat. No. 2,848,108. Brasted specifically rejects the electrostatic dispersion and transport of particles in suspension, used by the present invention, in favor of mechanical vibration of electrodes to transport flour resting on the electrodes. Brasted uses a solid lower electrode 20, which is essentially horizontal (inclined no more than ±7½°)—in fact Brasted states that an inclination of over 15° is fatal. Flour is deposited upon, and supported by, the lower solid electrode, which is mechanically vibrated. This vibration of the lower solid electrode is the medium by which the powder (flour) is transported through the apparatus. The flour is sorted by the differential attraction of some particles to the upper electrode 22. Large openings 94 (or slots 154) may be provided in the upper electrode, separated by flat unperforated areas 96 and with raised rims 98, but the upper electrode does not serve as a sieve—the particles of flour are attracted upward and pass through the openings (dependent entirely upon the electrostatic attraction and not upon the hole size as in a sieve) and then rest upon the upper surface of the electrode. The upper electrode is then vibrated to transport the flour resting upon it. The side panels 100 of the upper electrode extend upward (away from the other electrode) and serve only to keep powder resting on the upper electrode from falling off the edges—they cannot have any effect upon the strength of the field.

My previous patent, U.S. Pat. No. 4,172,028 (1979), utilized two vertical screens opposing one another. At that time the emphasis was on separating fine particles, less than 44 microns (325 mesh). Processing on both sides proved to be effective for low specific gravity materials, <5.00 g/ml, but for larger particles with higher specific gravities a single screen is more efficient when operating at lower angles, 10 to 40 degrees from the horizontal, FIG. 1.

Another of my earlier patents, U.S. Pat. No. 4,071,169 (1978), suggested the use of angularly adjustable electrodes used for the purpose of sieving powders. This equipment had several flaws, one of which was in the powder input area (52) in FIG. 5. When the equipment was in zero to ten degrees operating position powders flowed in both directions—backwards and away from the conveying direction—resulting in the loss of powder.

Another problem developed with the converging edges of upper or lower electrodes, in figure eight. The converging edges of these electrodes do confine the powder to the processing area, but with a reduction of the electric field in the center, or major processing area. The end result is lower particle velocity and number of trials for sieving efficiently.

Furthermore, each of these devices required manual removal of the collection pans for the fines (sieved material)

or the coarse material. This labor was increased by the problems associated with the dispersion of the materials both laterally and lengthwise (especially in nearly horizontal operation) across the electrodes.

SUMMARY OF THE INVENTION

This invention utilizes the oscillation which is produced in a powder which is acted upon by an electrostatic field. The passing of particles from one electrode toward a second of opposite polarity will place a charge on the particle which causes oscillation, dispersion and movement toward the second electrode. This invention utilizes the oscillation of the particles to produce motion relative to classification screens. The oscillation produces the necessary trials against the screens for classification.

The primary object of the present invention is to provide improvements in the equipment design, such as an operating angle that permits a wider range of particle sizes and specific gravities to be processed.

A further object of the present invention is to provide sieving apparatus that restricts the lateral flow of particles along the length of the electrodes.

A further object of the present invention is to provide sieving apparatus that includes efficient particle collection apparatus.

A further object of the present invention is to provide sieving apparatus that starts processing particles immediately upon entry into the electrical field, yet avoids scatter and uncontrolled dispersion at the entry of the electric field.

A further object of the present invention is to provide methods for sieving that start processing particles immediately upon entry into the electrical field, yet avoids scatter and uncontrolled dispersion at the entry of the electric field.

The present invention includes an apparatus for classifying particles by size comprising: a source of direct potential having first and second terminals, a sieve electrode connected to the first terminal, a solid electrode connected to the second terminal. Particles are fed to a transfer point located between the sieve electrode and the solid electrode such that the particles disperse and oscillate between the sieve electrode and the solid electrode whereby smaller particles pass through the sieve electrode. Collection means for receiving the particles passing through the sieve electrode are provided. This can include a cascading or surface flow gas-vacuum manifold system that maintains a static gas flow condition between the sieve and solid electrode for receiving particles passing through the sieve electrode and a separate gas-vacuum manifold system for receiving particles not passing through the sieve electrode.

The angle of the sieve electrode and the solid electrode can be adjusted together between vertical and horizontal positions. The spacing between the sieve electrode and the solid electrode can be adjusted such that a taper can be created in the spacing of the electrodes extending the length of the electrodes which prevents uncontrolled dispersion of the particles upon entry into the electrical field.

The sieve electrode can have frame side panels at an angle that produces an inter-reactive electrical field that confines powders to a process area between the electrodes. The solid electrode can have sides that are contoured to produce an asymmetrical electrical field that deflects and confines powders to a process area between the electrodes. A cleaning grid electrode can be provided which includes closely spaced, parallel, fine wires mounted parallel to the direction of powder flow behind the sieve electrode, for pulling the particles having passed through the sieve electrode away from the sieve electrode.

The solid electrode under the teachings of the invention may be contoured in various designs to increase the oscillation of the particles. The electrode may be contoured in side-to-side sine wave, sawtooth, or steps, or may be dimpled across the electrode. A wire grid electrode may be provided between the solid and sieve electrodes to increase the oscillation effect as well.

The invention also comprises process for classifying particles which comprises transferring electrostatically charged particles to a transfer point located between a sieve electrode and a solid electrode connected to a first and second terminal of a source of direct potential such that apertures of the sieve electrode are in operative proximity to the transfer point and the particles disperse and oscillate between the sieve electrode and the solid electrode whereby smaller particles pass through the sieve electrode. The particles can be transferred periodically (pulsed) to the transfer point.

Further objects of the invention will be set forth in the description which follows, and become apparent to those skilled in the art upon examination of the specifications or by practice of the invention.

BRIEF DESCRIPTION OF THE DRAWINGS

FIG. 12 is a flow diagram of the steps in the setup of a single stage sieving apparatus of the present invention.

FIG. 13 is a flow diagram of the process sequence of a single stage sieving apparatus of the present invention.

DETAILED DESCRIPTION

The present invention relates to method and apparatus for an electrostatic dry powder sieving device that sizes powders through a conductive woven screen or a chemically etched or electroformed screen. The term "sieve" is intended to apply to either a woven screen or an etched screen. One skilled in the art of the present invention would select one or the other depending upon the accuracy required and the size of the particles being classified.

The advantages and benefits of using the electrostatic sieving apparatus and methods of the present invention include: 1) powders separate into discrete particles, 2) agglomerated or clusters of particles are dispersed, 3) finer particles adhering to the surface of larger particles are striped, leaving a cleaner, large particle, and 4) magnetized powders are demagnetized. Observation has shown that particles made up of finer particles, (clusters), are mixers of the basic metal plus oxides or oxide surface coated particles, bonded together by electrostatic forces. When these are processed in an electrostatic sieving apparatus these oxides are removed with the fines. Fine particles adhering to the larger particles have also been traced to oxides that can be stripped from the larger particle by the electrostatic dispersion process.

Figure 1:
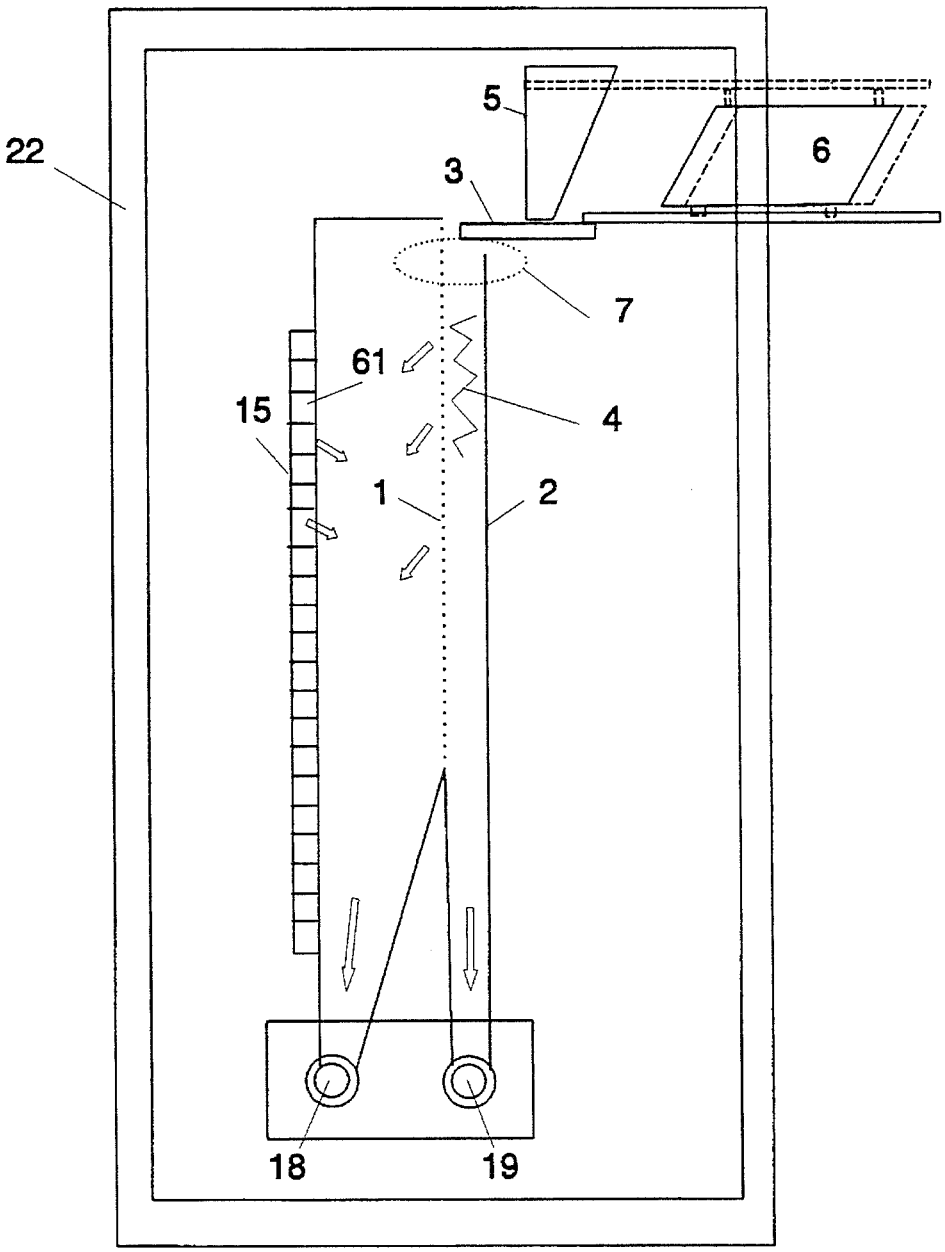
FIG. 1 is a cross sectional view of one embodiment of a sieving apparatus of the present invention.

Referring now to FIG. 1, a cross sectional view is shown of one embodiment of a sieving apparatus of the present invention. The powder enters the sieving apparatus at a controlled rate and is immediately dispersed by an induced charge from an electric field. Because it is an electrostatic system the particles can change their polarity by contact. The end result is that the particles move back and forth (oscillate) at a rate dependent upon the spacing between electrodes, the potential or field strength, the specific gravity and the operating angle of the screen electrode.

In the electrostatic sieving process, powders basically flow downward and laterally between the sieve electrode 1 and the solid electrode 2. A specific problem is related to the powder leaving the ends of the feeder tray 3 and being repelled laterally by other particles as their progress down between the two electrodes 1 and 2. If this lateral flow is not controlled the number of trials required for particles to pass through the sieve aperture will be insufficient.

This problem is specially related to the use of precision electroformed sieves. With standard woven sieves this problem can be partially solved by using a wider sieve material. However with electroformed sieves the precision or aperture tolerance is difficult to maintain as the size of the sieve is increased. The size of the present electroformed sieves are 11×11.

Another problem that is related to the control of lateral flow is the control input of fine and very fine powders. For fine powders the desired powder input is a monolayer of powder distributed uniformly across the width of the feeder tray. With very fine powder, <20 microns, the tendency is for the powder to channel and flow in several layers. Erratic and random powder input can cause an overdose of particles, leading to a possible momentary electrical short along with a variation of the electrical field strength.

The methods used to control these problems include: 1) pulsing the powder input, 2) using channeled feeder trays, 3) adjusting the solid electrode so that it is on an angle producing a wider opening at the top then the bottom, and 4) placing the sieve apertures directly in front of the feeder tray exit.

Pulsing the powder input substantially reduces both problems by essentially controlling the gas-to-solids ratio or the spatial density of particles. The present invention includes a process for classifying particles wherein the particles are responsive to a direct electrostatic field. The particles to be classified can be electrostatically charged. The particles are transferred to a transfer point located between a sieve electrode 1 and a solid electrode 2 connected to a first and second terminal of a source of direct potential. The particles disperse and oscillate between the sieve electrode 1 and the solid electrode 2 whereby smaller particles pass through the sieve electrode 1. The particles which have passed through said sieve electrode are then collected. The particles are transferred periodically (pulsed) to the transfer point. This helps to control the spatial density of particles within the processing area.

Figure 2:
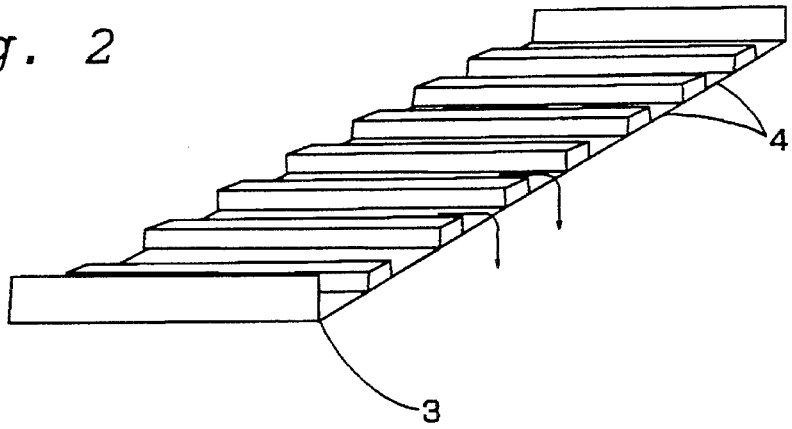
FIG. 2 is a detail view of a feed tray used to feed particles to a sieving apparatus of the present invention.

FIG. 2 shows another method used to control lateral powder dispersion. FIG. 2 is a detail view of a feeder tray 3 used to feed particles to a sieving apparatus of the present invention. The feeder tray 3 has a number of channels 4 that may vary in width and location. The most effective embodiment was to add channels at each end leaving the center open.

Figure 3:
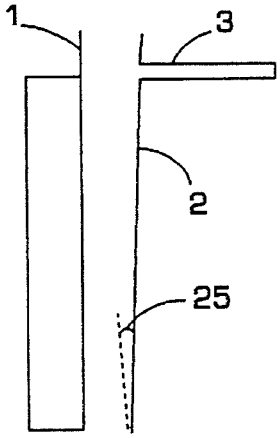
FIG. 3 is a representational diagram showing the ability to adjust the spacing between the sieve and solid electrodes such that a taper is created.

FIG. 3, shows another effective way of controlling problems related to powder input. FIG. 3 is a representational diagram showing the ability to adjust the spacing between the sieve and solid electrodes 1 and 2 such that a taper is created. The taper should be slight 0–3 degrees with the optimal range of 0.5–2.0 degrees 25. The process of sieving would include adjusting the spacing between the sieve electrode 1 and the solid electrode 2 such that a taper can be created in said spacing of the electrodes 1 and 2 extending the length of the electrodes 1 and 2. By angling the solid electrode 2 at the base 0.5 to 2.0 degrees a gradient electrical field is produced that allows the powder to gradually become influenced by the electrical field thereby distributing the dispersion over a greater length of the sieve electrode 1.

Figure 4:
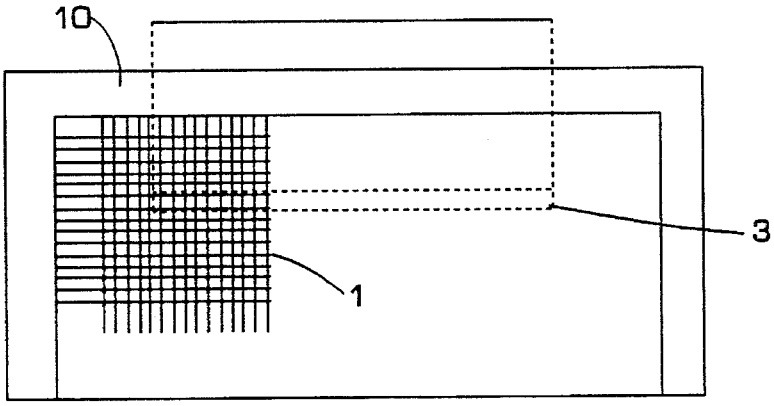
FIG. 4 is a representational diagram showing the transfer point of particles entering a sieving apparatus of the present invention.

FIG. 4 is a representational diagram showing the transfer point of particles entering a sieving apparatus of the present invention. As shown in FIG. 4 the apertures of the sieve electrode 1 are in operative proximity to the transfer point. The advantage of this electrode 1 and feeder 3 arrangement is that the powder immediately starts to process reducing the quantity of powder that would have influenced lateral dispersion.

Figure 5A:
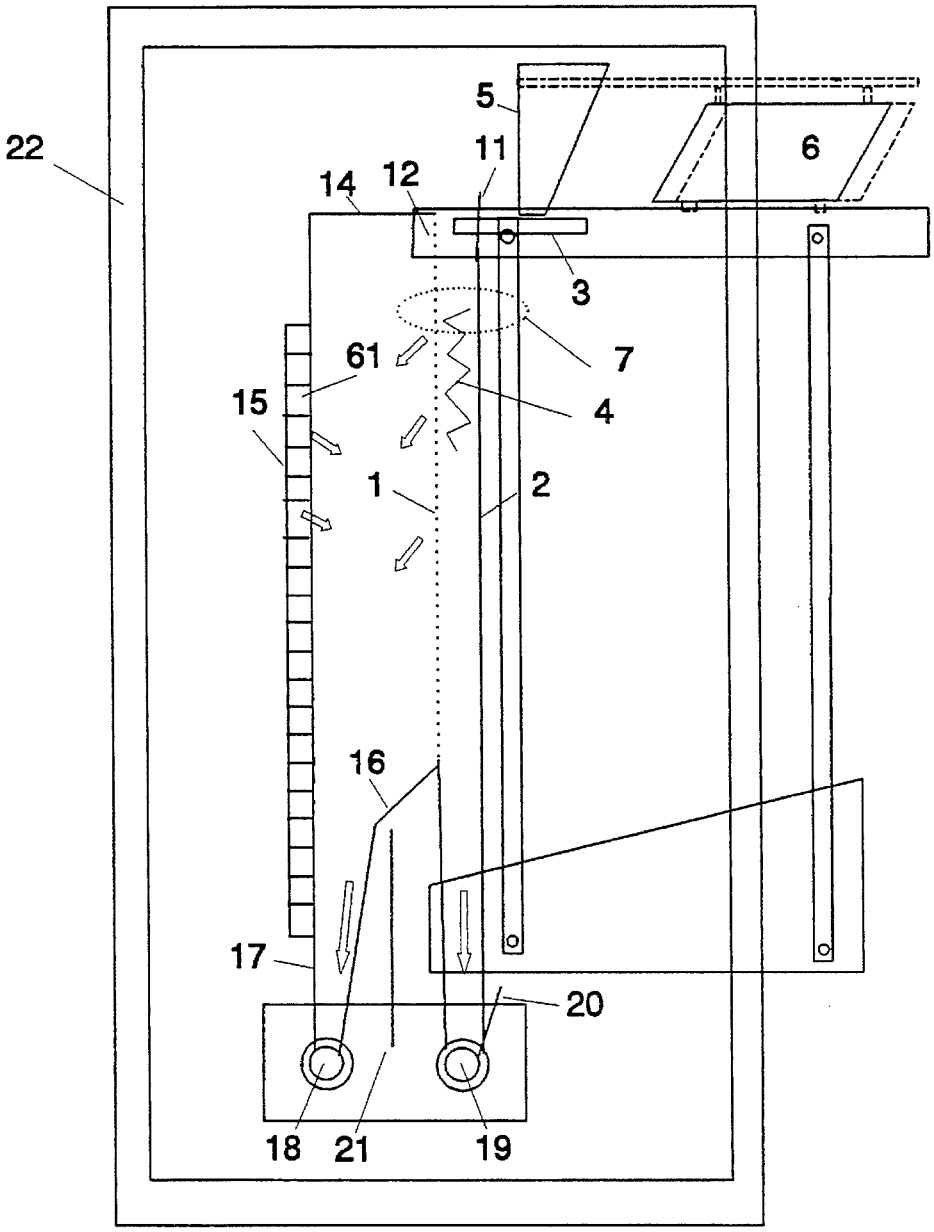
FIGS. 5*a* and 5*b* are detailed side views of one embodiment of a sieving apparatus of the present invention shown in adjusted positions between horizontal and vertical.
Figure 5B:
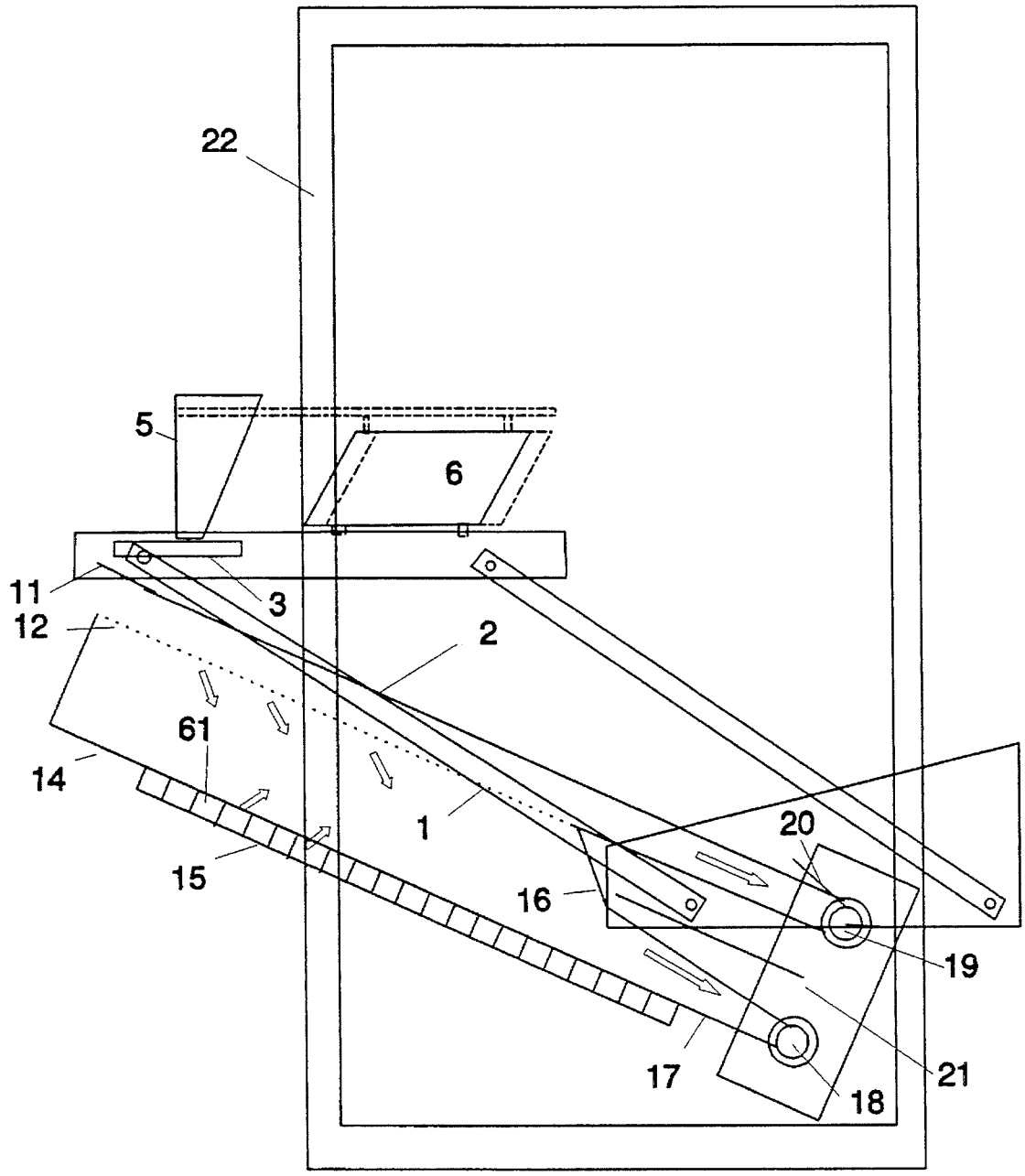

FIGS. 5*a* and 5*b* are detailed side views of one embodiment of a sieving apparatus of the present invention shown in adjusted positions between horizontal and vertical. FIGS. 5*a* and 5*b* show two of the various operating modes. The process of classifying particles includes adjusting the sieve electrode 1 and the solid electrode 2 together between vertical and horizontal positions. The 30 degree operating angle shown in FIG. 5*b*, may be used to process particles which are relatively large (~635 microns (0.025")) and have a relatively high specify gravity (>10). Adjustment to near 90 degrees would be used for finer particles.

The relationship between particle size, specific gravity, and the operating angle of the electrodes is related to the required resident time of particles in the processing area of the screen electrodes. Operating close to horizontal, as shown in FIG. 5*b* offsets the effect of gravity on large particles. The effect on particle oscillation is compensated by increasing the field strength between electrodes 1 and 2.

Processing of powders that are fine (>20 microns (0.000787") in diameter) and some close to the specific gravity of air (~1) have a tendency to remain suspended and diffuse laterally because of repelling forces between particles. This effect is compensated by operating at near vertical or vertical, FIG. 5*a* , utilizing the effect of gravity on particles.

The operating angle has evolved as a critical factor when processing large particles with high specific gravities. An example can be found in the sieving of lead alloys with a particle size range of 400 to 700 microns and specific gravities greater than 7.50 g/ml. When processing this material in a vertical mode the efficiency was <20 percent. With the new unit operating at 30 degrees the efficiency of separation was >96 percent.

The new equipment has five adjustable operating parameters, screen angle, spacing between electrodes, field strength, powder input rate and electrode taper. The taper between electrodes is usually small (0.3 to 0.4 degrees) with the larger opening at the top. The taper is used when the input powder is fine and the particle size differential is skewed either towards the high or low side. The purpose of the taper is to reduce the possibility of arcing at the input as well as to control dispersion of the particles.

The sieving unit can include: a powder hopper 5 and feed trough 3, a solid or deflecting electrode 2 in close proximity to the feed trough 3, and a sieve electrode 1. The sieve electrode 1 is at 10 to 20 KVDC and the solid electrode 2 is at ground potential. A cleaning grid electrode can be provided at ground potential, located behind the sieve electrode 1. The electrodes would each have support frames, wherein sieve electrode support frame 10 can be made out of angled aluminum. The new adjustable sieve design can also use the dispersing grid electrode, U.S. Pat. No. 4,172,028, FIG. 2 (23) and FIG. 3 (33), as a means of breaking down the lightly bonded clusters of powder.

In the embodiment shown in FIGS. 5*a* and 5*b*, vibratory feeder 6 removes powder from the hopper 5 and discharges the powder into zone 7 where a D.C. electric field has been established. The powder receives an induced charge and immediately disperses into discrete particles 4 and begins to oscillate between electrodes 1 and 2. Particle oscillation is the result of repeated polarization changes and to a lesser degree, the physical deflection of particles. As smaller particles pass through the sieve electrode 1 they fall in the direction of the arrows to be collected.

The electrostatic sieving unit operates in either a batch or continuous system where the powder is not collected on the screen but in pans. This feature combined with the gentle oscillation of particles on the screen permits the use of precision screens without the reinforcing grids which can substantially reduce the transmission or percent porosity of the screen.

The unit also includes a feeder electrode 11 (Grounded) and an adjustable sieve upper electrode (Neg. Charge) 12. A splitting apparatus could split the powder entering a sieving apparatus that would include one solid electrode 2 and two sieve electrodes 1 on either side of the solid electrode 2. A structural frame 13 is provided for electrode mounting. Side dielectric baffles 14 are shown. A cascading air manifold 15 is shown in dashed lines wherein the air current is shown by the arrows. A sieve electrode frame extension 16 is shown to guide the particles along with a deflector 17 into a vacuum system 18 for fine particles. When processing fine powders, dielectric baffles 14 are used in the collection chamber to prevent charged particles from flowing back into the processing area. A vacuum system 19 for coarse particles includes a deflector 20 which allows air to enter such that there is a static gas flow condition between the electrodes 1 and 2. A dielectric divider 21 is included. A chassis 22 supports the unit.

In FIG. 5*b* the unit is tilted such that the sieve electrode 1 and the solid electrode 2 move together, with the rest of the apparatus adjusting appropriately. The means for adjustment can be provided in a number of ways. Design should allow for easy adjustment and access to the sieving unit.

Figure 6:
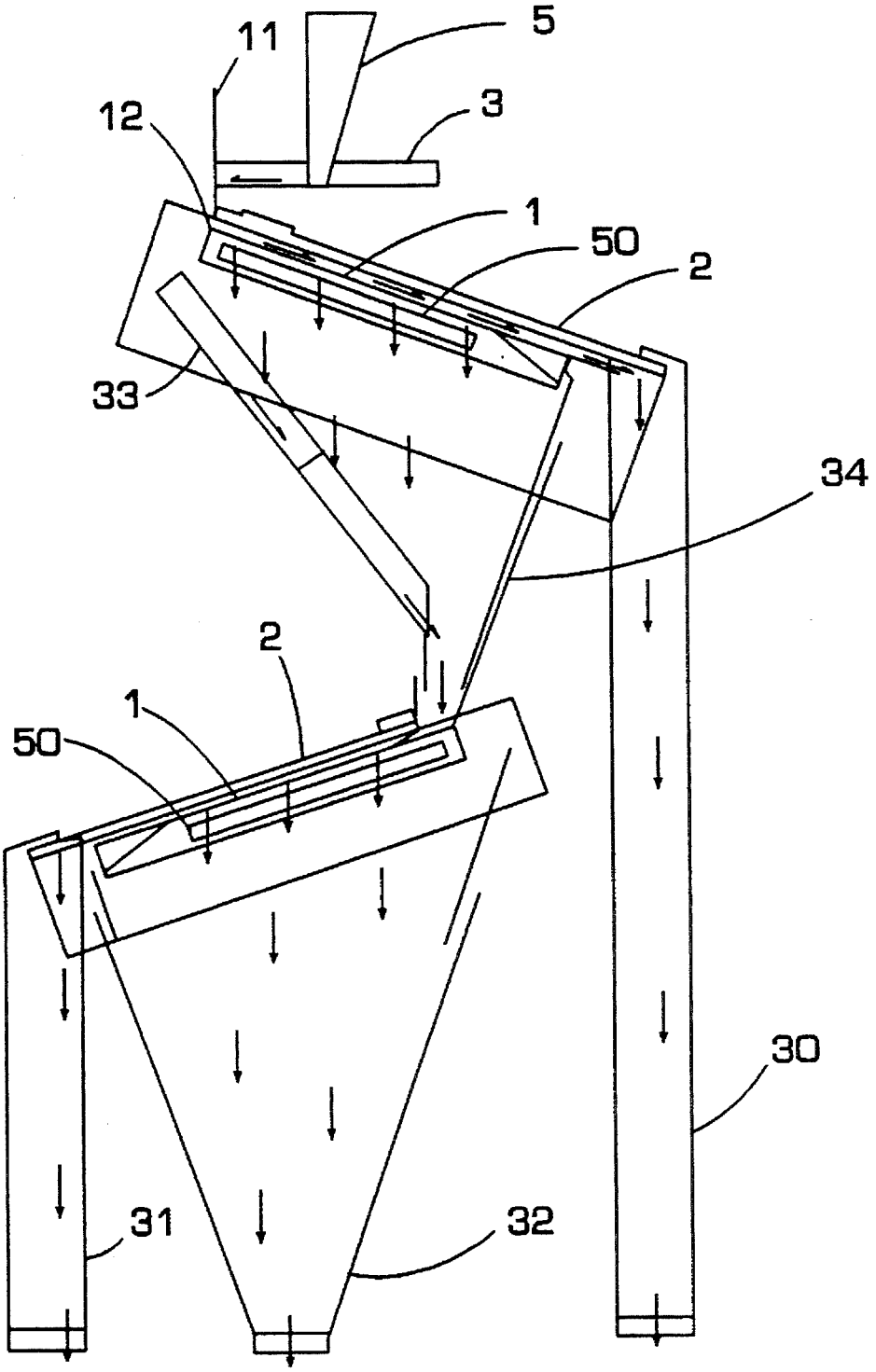
FIG. 6 is a side view of a two stage electrostatic sieving unit of the present invention.

FIG. 6 is a side view of a two stage electrostatic sieving unit of the present invention. FIG. 6 shows chute 30 for collecting large particles, chute 31 for collecting middling, and chute 32 for collecting fines. A feeder pan 33 and end guide plates 34 direct the flow of middlings for the second unit. Such an embodiment could be used for classifying particles according to a range of sizes and might be desirable for laboratory use or more efficient manufacturing work. A series of units could be designed to classify into many more than three sizes.

Figure 7:
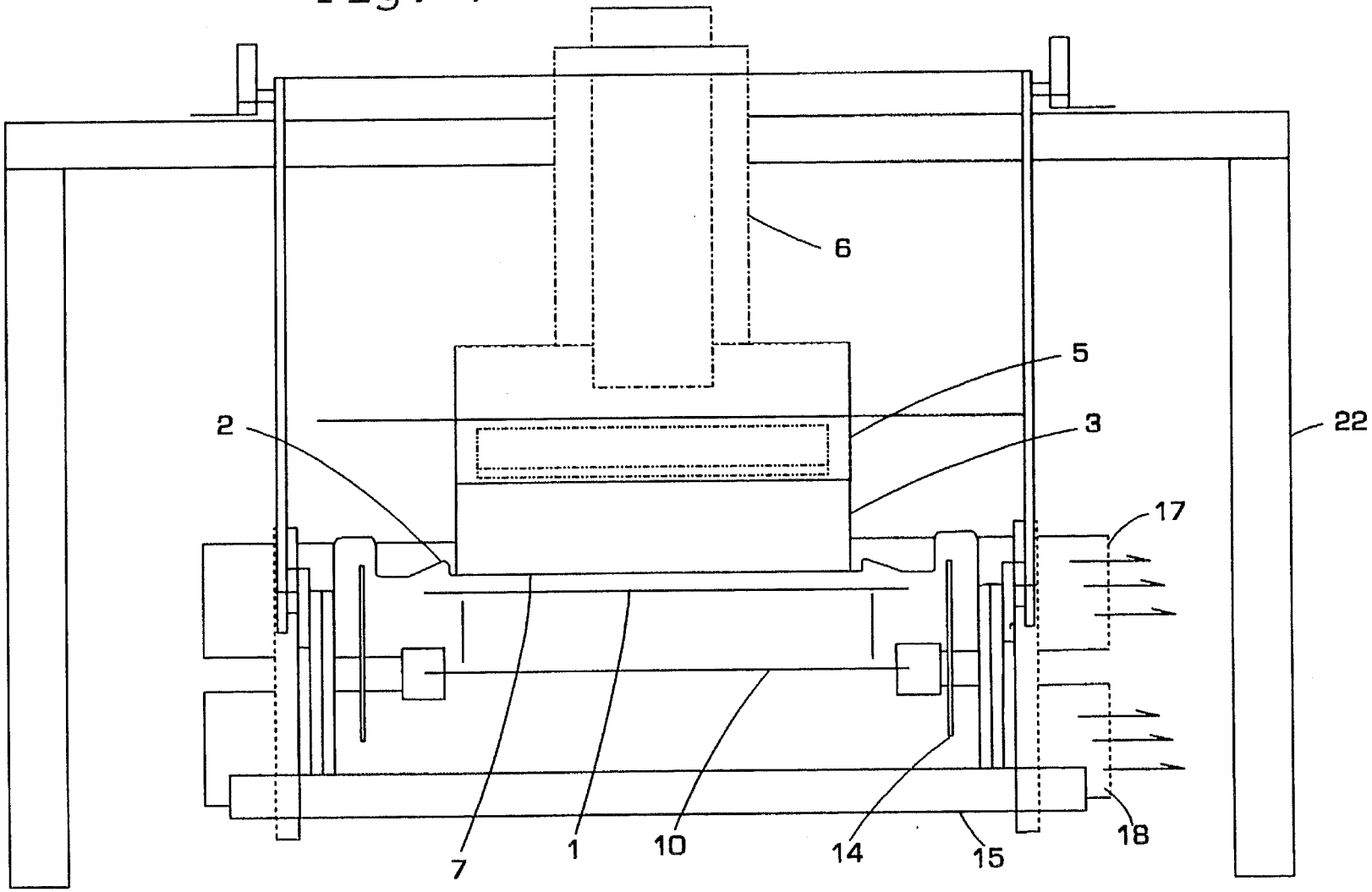
FIG. 7 is a cross sectional top view of one embodiment of a sieving apparatus of the present invention.
Figure 8A:
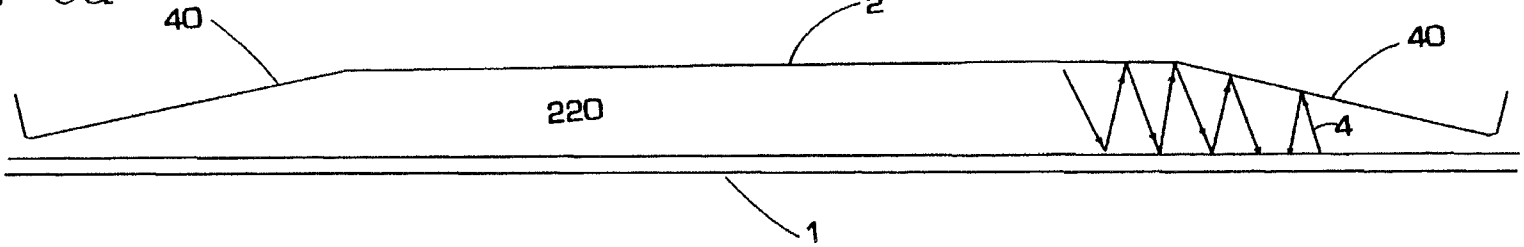
FIGS. 8*a–c* are cross sectional views of the screen and solid electrodes showing different contours of the solid electrode for deflecting and confining powders to a process area.
Figure 8B:
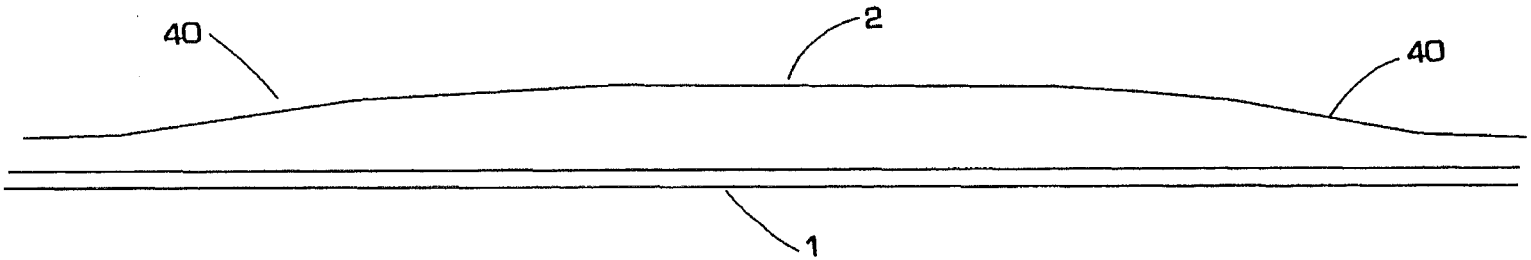
Figure 8C:
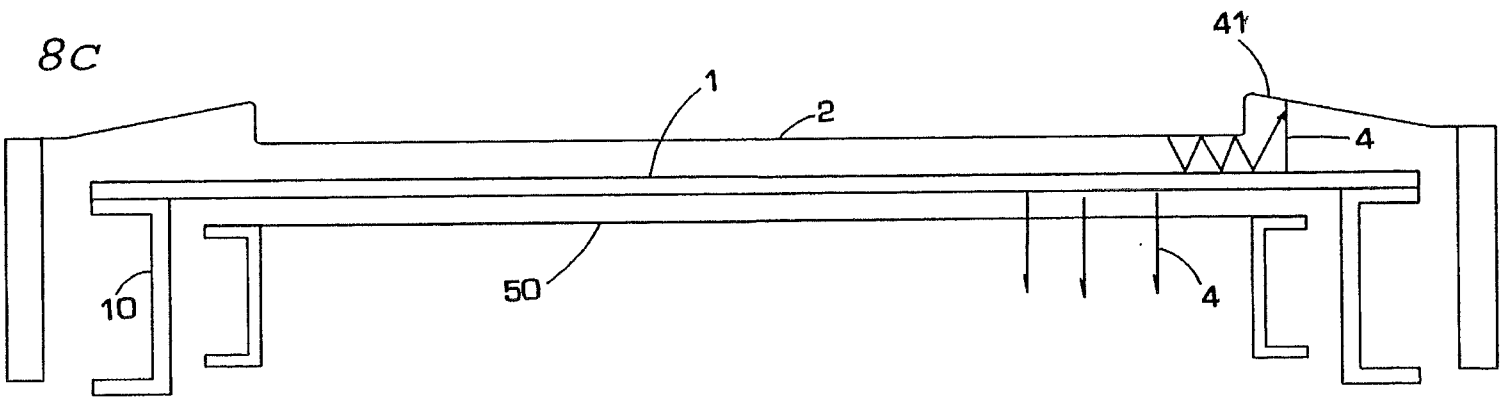

FIG. 7 is a cross sectional top view of one embodiment of a sieving apparatus of the present invention. The support frame 10 and the dielectric baffles 14 can be more clearly seen. This is the same embodiment shown in FIG. 9*a*. FIG. 8*a*, 8*b*, and 8*c* are cross-sectional views illustrating the changes in the solid electrode design dating back to 1978, U.S. Pat. No. 4,017,169, to the present. The solid electrode was originally a flat plate and quickly changed to the design shown in FIG. 8*a*.

The purpose of each design is to achieve confinement of the particles to the processing area of the screen. Excess lateral flow can result in electrical leakage or a short circuit by the coating of dielectric supports. The problem of lateral movement increases as the operating angle of the screen is adjusted from a 90 degree vertical angle towards a horizontal, 0 degree operating angle. Problems associated with designs shown in FIGS. 8*a* and 8*b*, are related to the distribution of the electric field and how it affects the efficiency of separation.

The design shown in FIG. 8*a* resulted in a uniform field between the two downward curves 40. The field strength gradually intensifies down the curves 40, resulting in a negative effect of lower particle velocity and fewer trials for the particles in the processing area 220. The design shown in FIG. 8*b* has basically the same problem but the efficiency of separation was improved due to the arc shape.

FIG. 8*c* represents the best mode of the present invention that achieves particle confinement and a uniform electric field. The lower field strength at point 41 benefits the confinement process by allowing the physical deflection of particle to be the dominating force. The uniform field can now be at its maximum enhancing the number of trials and the efficiency of separation for a given size screen. The number of trails is not the only benefit gained by this design. Higher field strength yield a more perpendicular movement of particles between electrodes, resulting in efficient seizing of particles. The design of FIG. 8*c* is that it is easier to fabricate than the arch design.

Figure 9A:
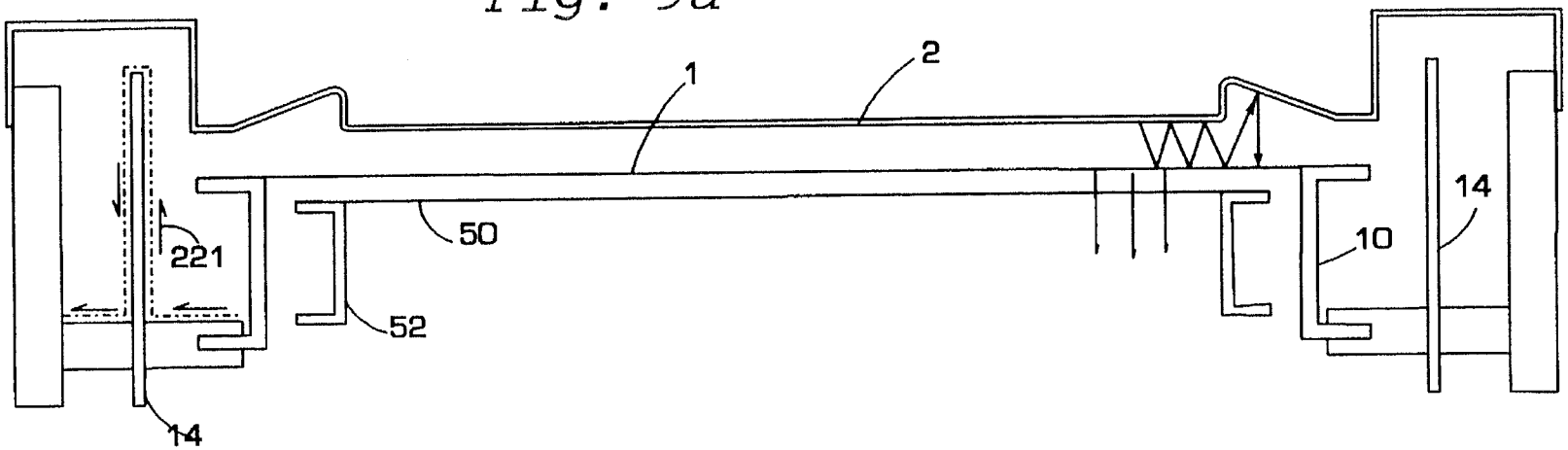
FIGS. 9*a–c* are cross sectional views of the screen and solid electrodes showing different contours of the screen electrode frame for deflecting and confining powders to a process area.

FIG. 9*a* shows a dielectric baffle 14 used to increase the electrical path and prevents a gradual electrical leakage or a direct electrical short. One problem with any system where the electrodes are connected by insulators along the processing area is that fine powder will almost inevitably escape and cling to the insulators thereby allowing them to conduct current along their surface. Eventually an electrical path which shorts out the system may develop as shown in FIG. 9*a* by the arrows 221.

Figure 9B:
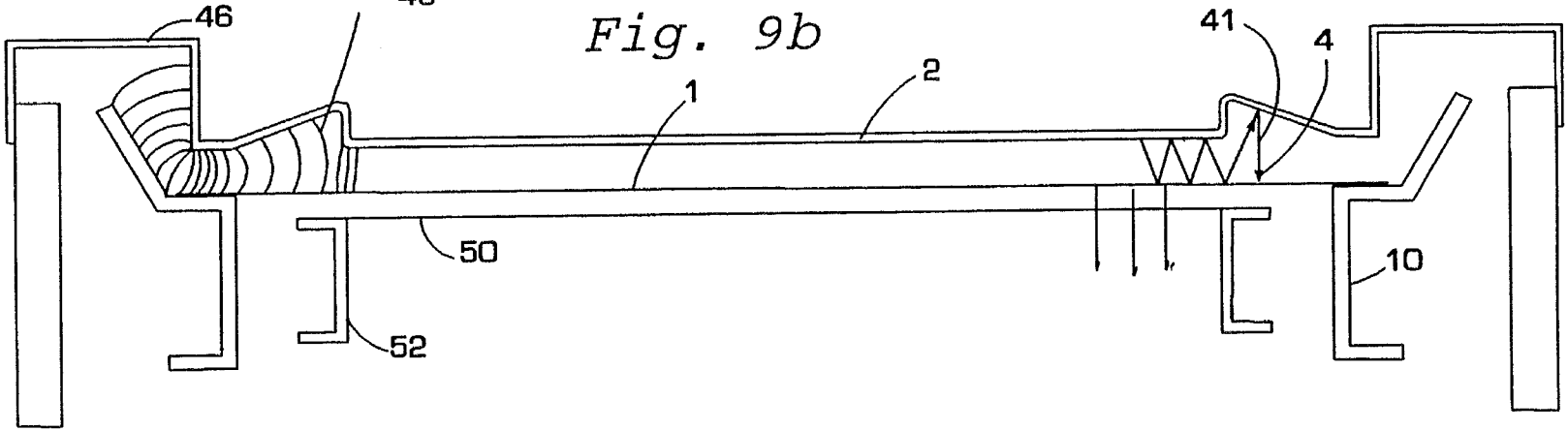
Figure 9C:
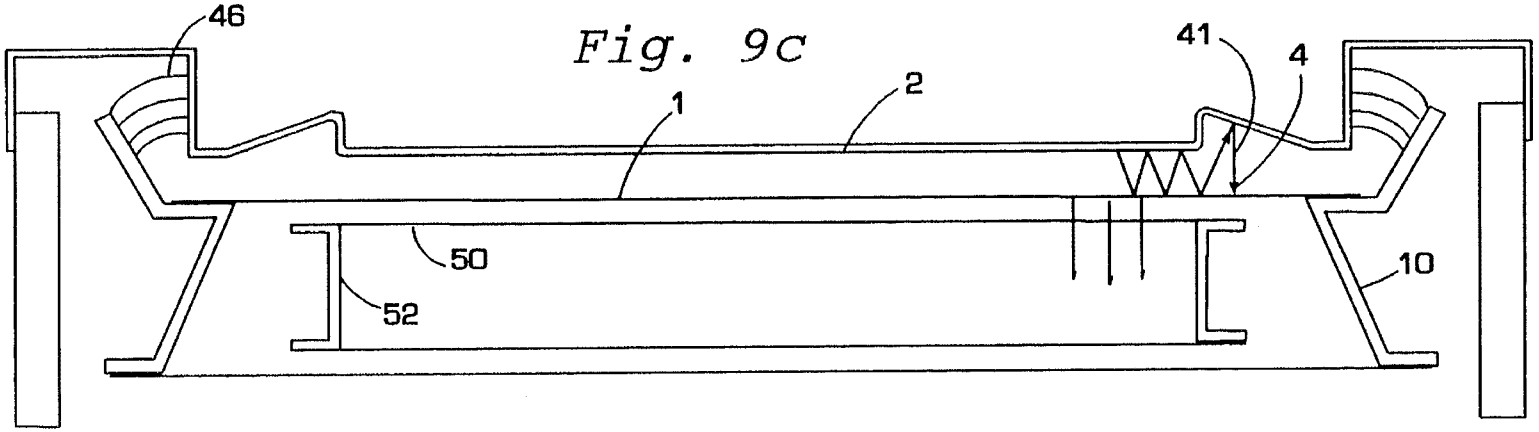

FIGS. 9*b* and 9*c* show a modification to the sieve electrode frame 10. The sides of frame 10 are extended and put on an angle (for example, 45 to 70 degrees from horizontal). Combining the changes made to solid electrode 2 and the sieve frame 10 results in creating two electrical field gradients as shown by the arcs 45 and 46. If particles pass the gradient and deflection at 45, they will accumulate at 46 because of the high strength and travel down and into the collection system. In this way the lateral dispersion is controlled and any particles leaving the screen area are quickly brought out of the system.

Figure 10:
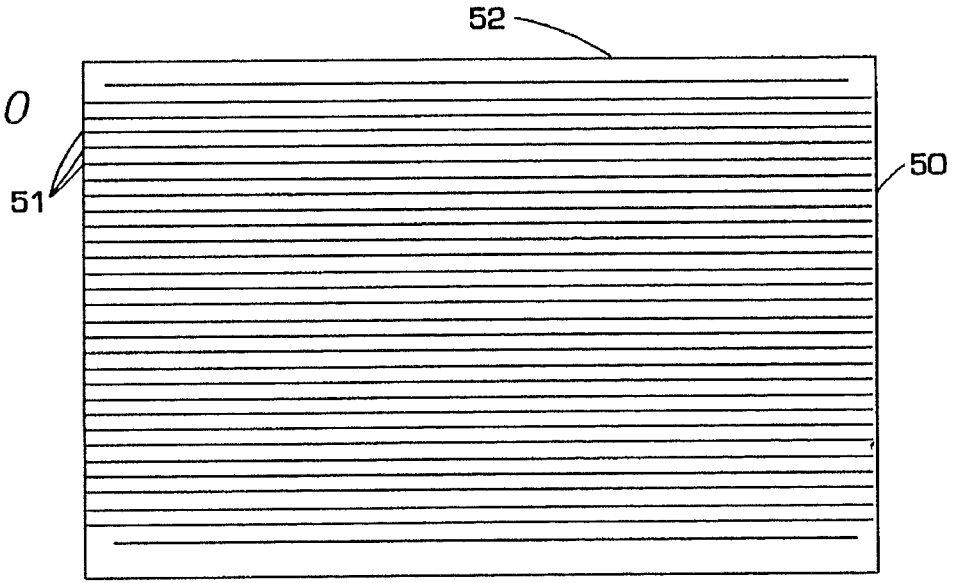
FIG. 10 shows an improved design for a cleaning grid for pulling the particles having passed through the sieve electrode away from the sieve electrode in a sieving apparatus of the present invention.

A cleaning grid 50 for pulling the particles having passed through the sieve electrode away from the sieve electrode 1 can be included. When processing fine powders a cleaning grid electrode 50 is placed behind the screen electrode 1. This grid 50 has a much larger apertures than the screen electrode 1. Its function is to attract and prevent particles that have passed through the screen electrode from drifting back to the back side of the screen electrode and causing a blockage problem. FIG. 10 shows an improved design for a cleaning grid 50 for pulling the particles having passed through the sieve electrode 1 away from the sieve electrode in a sieving apparatus of the present invention. The previous design used a coarse woven mesh grid. That creates both a horizontal and a vertical electric field between the sieve electrode and the cleaning grid electrode. The horizontal wires of the grid would concentrate the electric filed in a direction that opposes gravity and interferes with the vertical decent of the particles. With the use of vertical wires 51 connected to frame 52, the electric field and gravity are complimentary, offering less resistance to particle decent and flow through. Another benefit includes a greater open area for particle passage.

An efficient method for removing processed fine powders has been to incorporate a vacuum system to capture the particles and transfer them to containers. One method shown in FIG. 1 uses a horizontal cascading gas manifold 15 in conjunction with a vacuum collection system 18 and 19. The purpose of the gas manifold system 15 is to prevent a negative gas flow to occur at the point of powder entry nor in the processing area between electrodes 1 and 2. The cascading gas manifold 15 has apertures 61 of various spacing that distribute the gas input so that the sized particles will be captured and removed by the gas flowing down over the manifold 15.

Figure 11A:
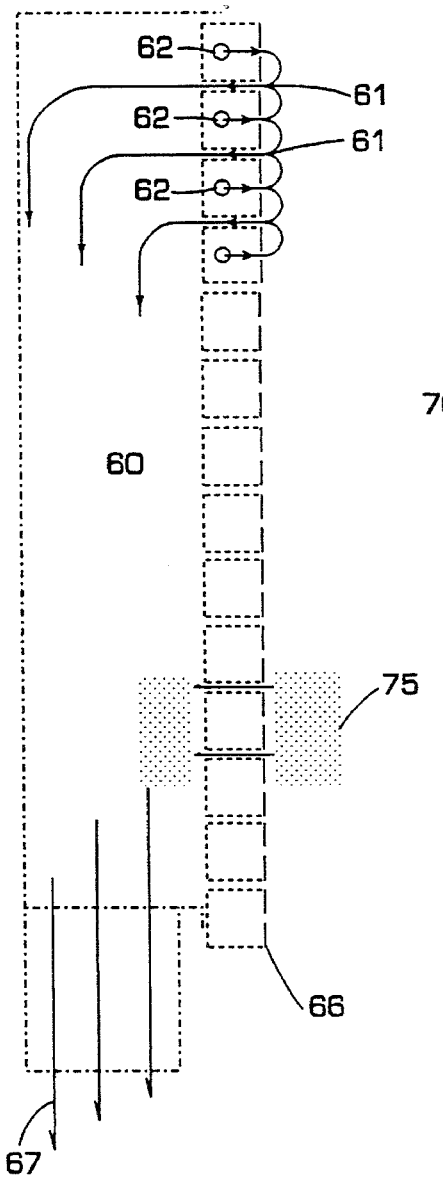
FIGS. 11*a* and 11*b* show a surface flow gas-vacuum manifold system of the present invention for collecting particles passing through the sieve electrode.
Figure 11B:
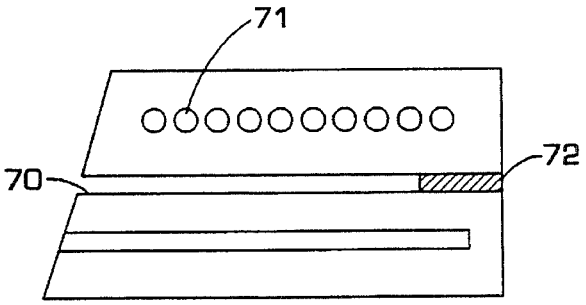

FIG. 11*a* and 11*b* show a surface flow gas-vacuum manifold system of the present invention for collecting particles passing through the sieve electrode. The vacuum collector 18 pulls a vacuum through the apertures 61. The inlet of air would come from holes 62 in the tubes 63 comprising the manifold. The advantage of surface flow manifold is that the depth of the gas and vacuum entry is controllable and restricted to areas close to the apertures of both the gas input holes 62 and the vacuum through the apertures 61. Gas aperture design variations are shown in FIG. 11*b* by slots 70 and holes 71, with the vacuum aperture controlled by spacer 72. Particles 75 are captured either by the gas flowing over the surface 66 of the manifold or at the vacuum aperture 61. Particle flow is shown by the arrows 67, indicating the exit into a receptacle.

FIG. 12 is a flow diagram of the steps in the setup of a single stage sieving apparatus of the present invention. The electrode spacing is set 130 along with the operating angle 131. The power 132 and the vacuum 133 are turned on. The hopper is loaded 134, the feeder is turned on and the pulse rate is adjusted 135.

FIG. 13 is a flow diagram of the process sequence of a single stage sieving apparatus of the present invention. Once transferred into the apparatus 136, the powder starts to disperse into discrete particles 137. The particles start oscillating between the sieve and solid electrodes and start classifying as the smaller particles pass through the sieve electrode 138. The fines and coarse particles are collected by gravity in containers 139. Alternatively, the coarse particles could be collected with a vacuum system 140, and the fines could be collected with a surface gas flow manifold system 141 or a cascading gas flow manifold system 142.

The embodiments of the invention in the preceding discussion have all been shown with a solid electrode which is essentially flat along its length (although it might be contoured from side-to-side as shown in FIGS. 9*a–c*). A preferred embodiment of the solid electrode which has been found to enhance the sieving action is shown in FIGS. 14–17. In contrast to the flat solid electrode of the earlier figures, the solid electrode of these embodiments 200 is contoured along its length. This causes the strength of the DC electric field to vary as the particles pass along the length of the electrode, as well as varying the angular deflection of the particles. The angle of deflection is a vector function between the contour of the electrode, field strength, and interelectrode spacing. The particles are induced by the contouring to oscillate between the two electrodes, which dramatically increases the number of trials against the sieve electrode 201 and greatly increases the efficiency of sieving. In each of FIGS. 14–16, the direction of powder flow is shown by the arrow, and 202 indicates the angle of inclination of the sieve electrodes.

Figure 14:
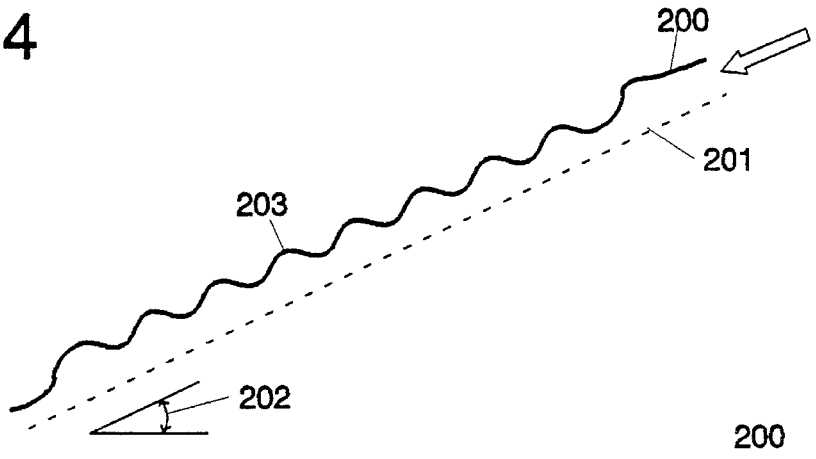
FIG. 14 is a side view of a contoured solid electrode in a sine-wave design embodiment.

FIG. 14 shows an embodiment in which the solid electrode is contoured in a sine-wave configuration. The object is to force a particle to have both a negative and a positive angular movement as it traverses the sieve electrode. The amplitude of the peaks 203 of the sine wave is approximately 0.1" in a sieve design with an electrode spacing of 0.75".

Figure 15:
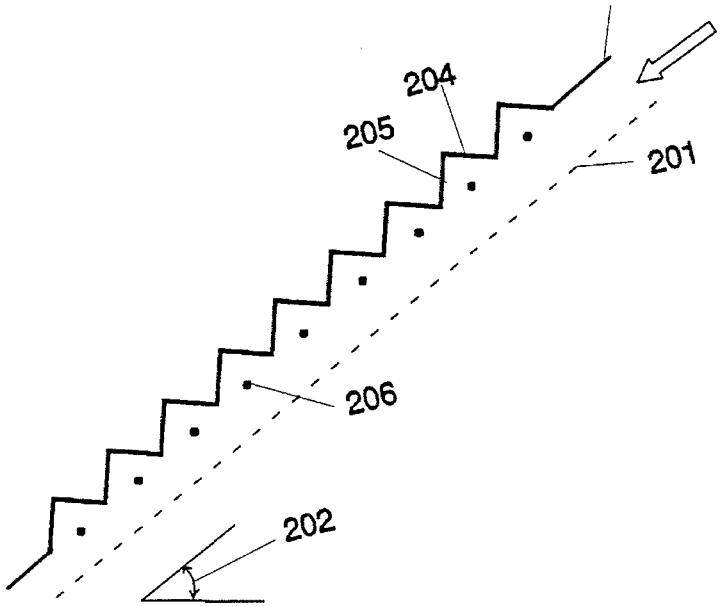
FIG. 15 is a side view of a contoured solid electrode in a triangular design embodiment, with additional wire grid electrode.

FIG. 15 shows a 45° operating angle 202 triangular design. This design is similar to the sine-wave design, except that it offers an added variable when it is used in combination with the wire electrode 206, comprising a wire located centered along the length of the hypotenuse of each of the triangles. The wire electrode 206 has the same charge as the solid electrode, and acts to produce a more random angular or turbulent particle motion, again increasing the number of trials of the particles against the sieve electrode 201. The wire can be moved in a perpendicular axis relative to the apex of the triangle, which modifies the influence of the wire electrode on particle behavior. In the 45° incline shown, sides 204 of the triangles are approximately horizontal, and sides 205 are approximately vertical. In an embodiment with a spacing between solid and sieve electrodes of approximately 5/16", the sides of the triangles 204 and 205 would be approximately 0.438", and the overall length of the triangles along the axis of the electrode would thus be approximately 0.75", with a height perpendicular to the axis of the electrode of approximately. 0.31".

Figure 16:
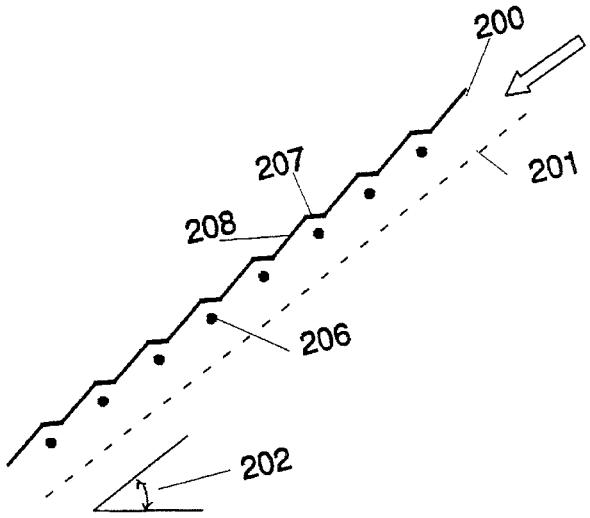
FIG. 16 is a side view of a contoured solid electrode in a sawtooth design embodiment, with additional wire grid electrode.

FIG. 16 shows an embodiment in which the solid electrode 200 has a saw-tooth design. This has been found to be the best mode of the contoured electrode known to the inventor. The wire electrodes 206 are also used in this embodiment, and the preferable operating angle 202 is again approximately 45°. This electrode is specifically designed to create a negative deflection, or a reduction in the normal deflection of the particle, thereby increasing the number of trials against the sieve 201. For an embodiment with a spacing between solid and sieve electrodes of approximately 5/16", the longer sides of the sawtooth 208 would have a dimension of approximately 0.75" and the shorter sides 207 would be approximately 0.125". The angle of the two sides would be preferably about 90°, giving a height perpendicular to the axis of the electrode of approximately 0.31".

Figure 17:
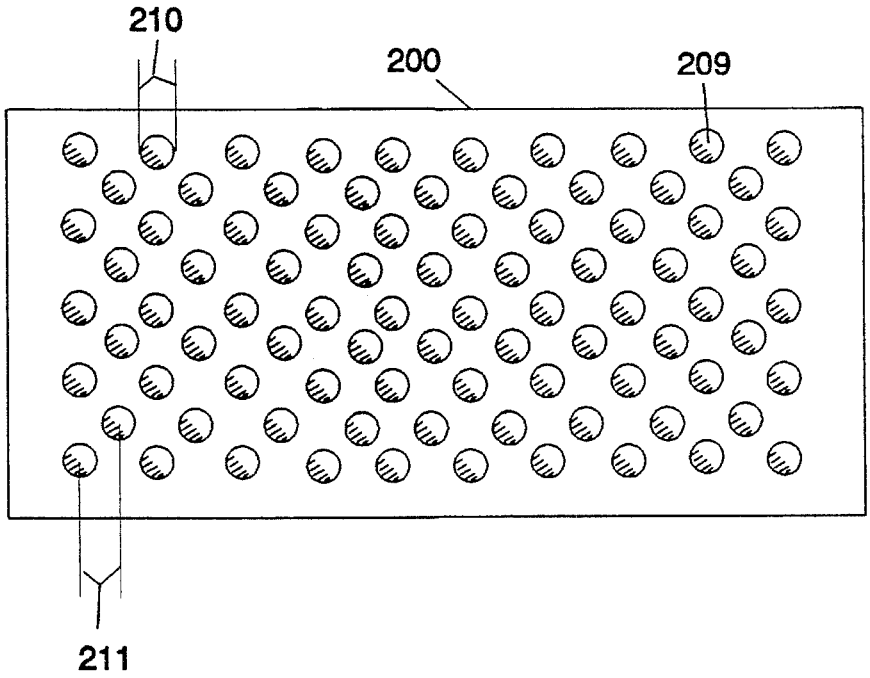
FIG. 17 is a view of a contoured solid electrode in a dimpled design embodiment.

FIG. 17 shows a dimpled solid electrode 200. The electrode has a pattern of concave or convex dimples 209 arranged across its surface in a uniform grid or in the preferred offset pattern shown. In the embodiment of the dimpled electrode shown, assuming a spacing between solid an sieve electrodes of about 5/16", the dimples would be between 0.25" and 0.75" in diameter 210 (preferred approximately 0.4"), with a center-to-center spacing 211 between 0.125" and 1.5" (preferred approximately 0.98"). The dimples in such an embodiment would be between 0.02" and 0.25" (preferred approximately 0.08"). The dimple design evolved out of the increased lateral flow of particles in the wave, triangle and sawtooth designs of FIG. 14–16. The lateral motion is more prevalent with a lower electrode operating angle and at the beginning of the process or when fine powders are processed. The lateral particle flow is associated with charged particles interacting and simultaneously repelling each other in all directions. Another way to explain the dimple design is to say that the lateral particle path is discontinuous while maintaining angular random motion.

It will be understood by one skilled in the art that the various contoured electrode designs are not mutually exclusive, but could be combined with each other and with the side-to-side contouring of FIGS. 9*a–c*. For example, the portion of the solid electrode near the entrance of the powder could be supplied with dimples, and then change to a sawtooth design further down where the particles are suitably dispersed laterally. The side portions of electrodes of any of these designs could be provided with the raised side contours of FIGS. 9*a–c*.

Figure 18:
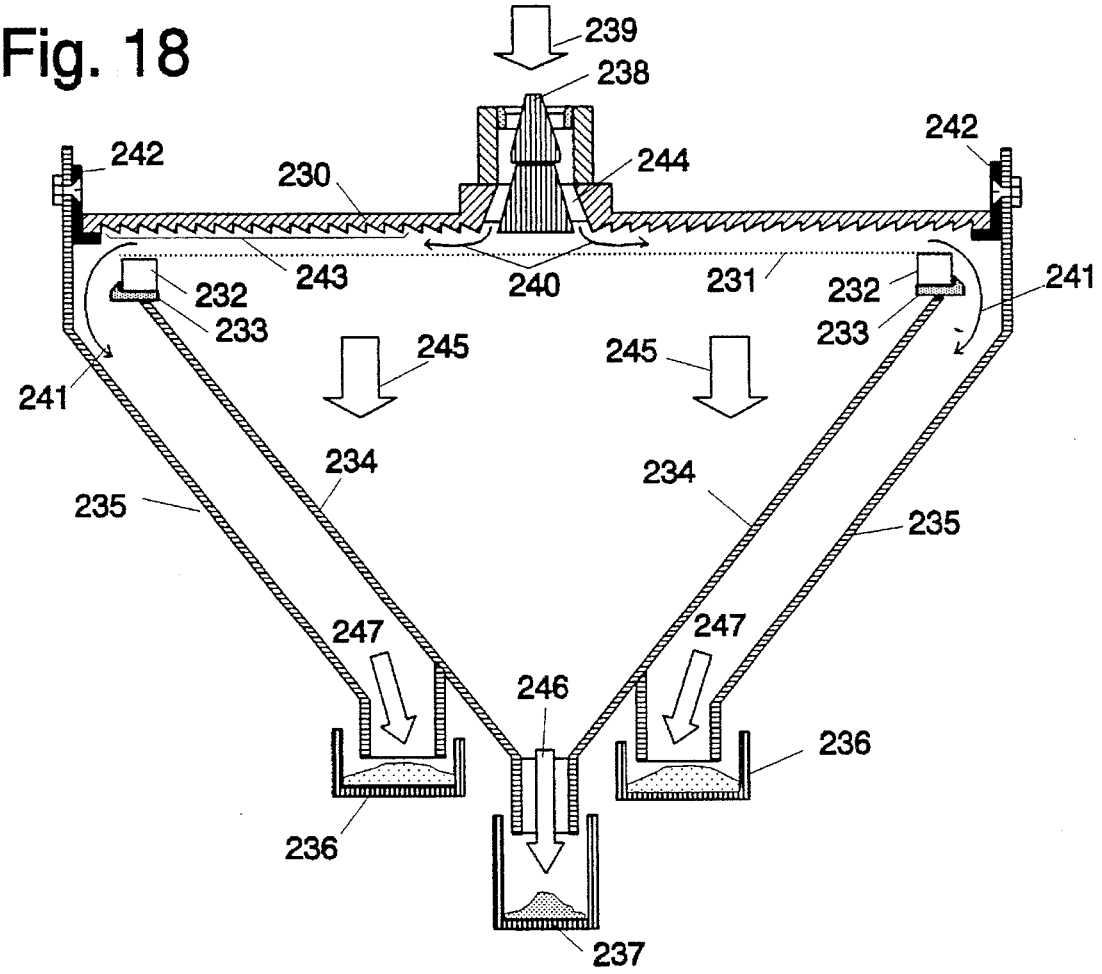
FIG. 18 is a side cut-away view of a sieve using a circular contoured solid electrode
Figure 19:
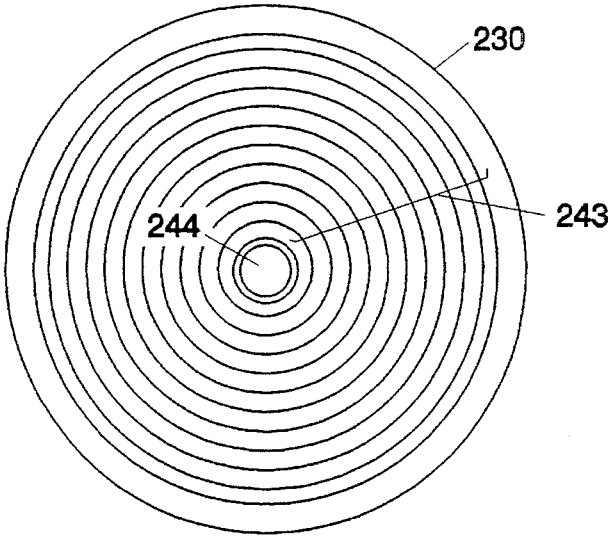
FIG. 19 is a bottom view of a circular contoured solid electrode used in the sieve of FIG. 18.

FIGS. 18 and 19 show how a circular horizontal electrostatic sieving device can be built according to the teachings of the invention, using the contoured solid electrode embodiment of the FIGS. 14–16.

In the embodiment of FIGS. 18 and 19, the solid electrode 230 is circular, with sawtooth contours 243 arranged on its lower side concentrically around a center hole 244. A conical disperser element 238 can be inserted into the hole to aid in dispersing the incoming powder to be sieved 239. The solid electrode 230 is supported by insulating brackets 242 around its perimeter. The brackets 242 are attached to a conical outer structure 235, which also serves to collect the coarse particles, as will be explained below. Underneath the solid electrode 230, with a gap between, is the sieve electrode 231, which is supported by a stretcher, preferably a circular ring of tubing with a square cross-section 232, itself supported on insulating brackets 233, which rest on an inner cone 234. The inner cone 234 tapers toward the bottom to collect the fine powder 245 passing through the sieve electrode 231, which passes 246 through the hole in the bottom of the cone 234 and falls into a collecting tray 237. The outer surface of the inner cone 234 forms the inner surface of a conical passage, the outer surface of which is the outer conical support 235.

The operation of the horizontal circular sieve is as follows: powder to be sieved is fed (arrow 239) into the opening 244 in the center of the solid electrode 230. As it passes by the disperser 238, it is broken up and dispersed, in order to increase the efficiency of the sieve. As the powder passes through the hole 244 into the gap between the solid electrode 230 and the sieve electrode 231, it flows radially outward (arrows 240) toward the perimeter of the electrodes under the influence of the electric field between the solid and sieve electrodes, and is induced to oscillate between the electrodes, in the same manner as described for the linear sieves of FIGS. 1–17. As the particles flow outward 240, they are tried against the sieve electrode 231, and the finer particles flow through the sieve (arrows 245) and down into the inner cone 234, passing out of the cone through the bottom (arrow 246) and falling into the fines collection tray 237. The coarser particles continue to flow radially outward, oscillating and being tried all the way, until they finally flow off the perimeter of the sieve electrode and into the conical outer support 235 (arrows 241). The coarse particles then flow through the gap between the inner 235 and outer 234 cones until they pass out of the bottom of the outer conical support 235 into a donut-shaped collection tray 236 (see arrows 247). The contouring 243 of the solid electrode 230 causes increased oscillation as the particles move radially outward, which increases the number of trials against the sieve electrode 231.

If required by the powder used, vibrators may be attached to the inner 235 or outer 234 cones to aid in passage of the particles along the walls of the cones. The safety of the embodiment is enhanced by the fact that the cones can be grounded, and the electrodes 230 and 231 are insulated from the cones by insulators 242 and 233, respectively.

The direction of the sawtooth design has an effect on the speed or residency time of the particles in the sieve. The direction of sawteeth shown in FIG. 18 will have the effect of speeding up the travel of the particles radially outward from their point of entry. If a slower particle speed is desired (i.e. longer residency time and more trials against the sieve electrode), then the sawtooth can be reversed, with the slope of the longer sides inward instead of outward. The sawtooth design can also be modified by lengthening the longer sides of the sawteeth (i.e. fewer concentric rings) and/or lengthening the shorter sides (i.e. deeper teeth) within the teachings of the invention.

Although the sieve of FIG. 18 is shown with an electrode contoured in the sawtooth shape shown in FIG. 16, it will be understood by one skilled in the art that the triangle or sine-curve contouring, or for that matter a flat electrode, could be used as well.

The circular arrangement of this embodiment of the sieve increases the efficiency of the sieve by completely eliminating the problem of lateral flow along the sieve to the edges, the problem which was addressed by the raised edges of the linear sieves of FIGS. 8–10. In this embodiment, all flow is radially outward from the central hole, and particles are continuously tried along the passage. The particles are essentially in free fall after they pass through the sieve, and no vacuum or gas manifold is needed.

The foregoing description has been directed to particular embodiments of the invention in accordance with the requirements of the Patent Statutes for the purposes of illustration and explanation. It will become apparent, however, to those skilled in the art that many modifications and changes will be possible without departure from the scope and spirit of the invention. It is intended that the following claims be interpreted to embrace all such modifications.

I claim:

1. An apparatus for classifying particles by size comprising:

a) a source of direct potential having first and second terminals;

b) a sieve electrode connected to said first terminal;

c) a solid electrode connected to said second terminal, the solid electrode having a variable contour along its length;

d) means for feeding particles to a transfer point located between said sieve electrode and said solid electrode such that said particles disperse and osciliate between said sieve electrode and said solid electrode whereby smaller particles pass through said sieve electrode; and e) collection means for receiving said particles passing through said sieve electrode.

2. The apparatus of claim 1 further comprising means for adjusting spacing between said sieve electrode and said solid electrode such that a taper can be created in said spacing of said electrodes extending a length of said electrodes.

3. The apparatus of claim 1 further comprising a gas-vacuum manifold system that maintains a static gas flow condition between said sieve and solid electrode for receiving particles passing through said sieve electrode.

4. The apparatus of claim 1 further comprising a gas-vacuum manifold system that maintains a static gas flow condition between said sieve and solid electrode for receiving particles not passing through said sieve electrode.

5. The apparatus of claim 1 further comprising a collection means located below said sieve and solid electrodes, whereby processed particles are collected by vacuum.

6. The apparatus of claim 1 further comprising a sieve electrode frame having side panels at an angle that produces an asymmetrical electrical field that confines particles to a process area between said electrodes.

7. The apparatus of claim i further comprising a solid electrode having sides with a contour which produces an electrical field which varies in strength and direction so as to deflect and confine particles to a process area between said sides of the solid electrode and maintain the strongest electrical field within said process area.

8. The apparatus of claim 1 further comprising a cleaning grid electrode including closely spaced, parallel, fine wires mounted parallel to the direction of particle flow, for pulling the particles having passed through said sieve electrode away from said sieve electrode.

9. The apparatus of claim 1 in which the variable contour of the solid electrode is a sine-wave design.

10. The apparatus of claim 1 in which the variable contour of the solid electrode is a sawtooth design.

11. The apparatus of claim 1 in which the variable contour of the solid electrode is a triangle design.

12. The apparatus of claim 1 in which the variable contour of the solid electrode is convex dimples.

13. The apparatus of claim 1 in which the variable contour of the solid electrode is concave dimples.

14. The apparatus of claim 1 further comprising a plurality of wire electrodes centered among the variable contours of the solid electrode, the wire electrodes being connected to the second terminal such that the wire electrodes are at the same potential as the solid electrode.

15. The apparatus of claim 1, further comprising means for angular adjustment of said sieve electrode and said solid electrode together between vertical and horizontal positions.

16. An apparatus for classifying particles by size comprising:

a) a source of direct potential having first and second terminals;

b) a sieve electrode connected to said first terminal;

c) a solid electrode connected to said second terminal, having sides with a contour which produces an electrical field which varies in strength and direction so as to deflect and confine particles to a process area between the sides of the solid electrode and maintain the strongest electrical field within said process area;

d) means for feeding particles to a transfer point located between said sieve electrode and said solid electrode such that said particles disperse and oscillate between said sieve electrode and said solid electrode whereby smaller particles pass through said sieve electrode;

e) collection means for receiving said particles passing through said sieve electrode.

17. The apparatus of claim 16 further comprising means for adjusting spacing between said sieve electrode and said solid electrode such that a taper can be created in said spacing of said electrodes extending a length of said electrodes.

18. The apparatus of claim 16 further comprising a gas-vacuum manifold system that maintains a static gas flow condition between said sieve and solid electrode for receiving particles passing through said sieve electrode.

19. The apparatus of claim 16 further comprising a gas-vacuum manifold system that maintains a static gas flow condition between said sieve and solid electrode for receiving particles not passing through said sieve electrode.

20. The apparatus of claim 16 further comprising a collection means located below said sieve and solid electrodes, whereby processed particles are collected by vacuum.

21. The apparatus of claim 16 further comprising a sieve electrode frame having side panels at an angle that produces an asymmetrical electrical field that confines particles to the process area between said electrodes.

22. The apparatus of claim 16 further comprising a cleaning grid electrode including closely spaced, parallel, fine wires mounted parallel to the direction of particle flow, for pulling the particles having passed through said sieve electrode away from said sieve electrode.

23. The apparatus of claim 16 further comprising means for angular adjustment of said sieve electrode and said solid electrode together between vertical and horizontal positions.

* * * * *